US005709779A

United States Patent [19]

May et al.

[11] Patent Number: 5,709,779

[45] Date of Patent: Jan. 20, 1998

[54] DEVICE FOR CONVEYING WASTE IN A PYROLYSIS REACTOR

[75] Inventors: Karl May, Bad Vilbel; Hartmut Herm, Dreieich; Karlheinz Unverzagt, Seligenstadt, all of Germany

[73] Assignee: Siemens Aktiengesellschaft, Munich, Germany

[21] Appl. No.: 625,404

[22] Filed: Mar. 27, 1996

Related U.S. Application Data

[63] Continuation of PCT/DE94/01058, Sep. 14, 1994.

[30] Foreign Application Priority Data

Sep. 27, 1993 [DE] Germany ..... 43 32 865.2

[51] Int. Cl.[6] ..... C10B 21/20

[52] U.S. Cl. ..... 202/100; 202/115; 202/99

[58] Field of Search ..... 202/99, 100, 118; 110/346; 48/111, 63

[56] References Cited

U.S. PATENT DOCUMENTS

| | | | |
|---|---|---|---|
| 1,480,152 | 1/1924 | Cox | 202/100 |
| 2,542,476 | 2/1951 | Cone | 302/37 |
| 2,723,226 | 11/1955 | Lesher | 202/100 |
| 4,142,867 | 3/1979 | Kiener | 202/100 |
| 4,344,821 | 8/1982 | Angelo, II | 202/100 |
| 4,465,556 | 8/1984 | Bowen et al. | 202/99 |
| 4,734,166 | 3/1988 | Angelo, II | 202/100 |

FOREIGN PATENT DOCUMENTS

| | | |
|---|---|---|
| 0 138 214 | 10/1986 | European Pat. Off. . |
| 0 302 310 | 2/1989 | European Pat. Off. . |
| 0 360 052 | 3/1990 | European Pat. Off. . |
| 38 30 151 | 3/1990 | Germany . |
| 38 30 152 | 3/1990 | Germany . |
| 38 30 153 | 3/1990 | Germany . |

*Primary Examiner*—Scott Kastler

*Attorney, Agent, or Firm*—Herbert L. Lerner; Laurence A. Greenberg

[57] ABSTRACT

A device for conveying waste includes a waste feed chute. A stationary conveyor pipe is connected to the waste feed chute and has a sealed-off end and a housing with a nonround cross section defining a longitudinal direction. A screw conveyor is disposed in the longitudinal direction of the conveyor pipe. A motor drives the screw conveyor. A pyrolysis reactor into which the conveyor pipe discharges, defines a first space between the housing of the conveyor pipe and the pyrolysis reactor. The pyrolysis reactor has an inlet end and a longitudinal axis about which the pyrolysis reactor is rotatable. An inlet tube in which the sealed-off end of the conveyor pipe is disposed, defines a second space between the inlet tube and the conveyor pipe. The inlet tube communicates with the inlet end of the pyrolysis reactor and has a smaller cross section than the pyrolysis reactor. At least one supply line leads from outside into the pyrolysis reactor. The at least one supply line is disposed in the first space and is extended through the second space.

9 Claims, 2 Drawing Sheets

DEVICE FOR CONVEYING WASTE IN A PYROLYSIS REACTOR

CROSS-REFERENCE TO RELATED APPLICATION

This application is a Continuation of International Application Serial No. PCT/DE94/01058, filed Sep. 14, 1994.

BACKGROUND OF THE INVENTION

Field of the Invention

The invention relates to a device for conveying waste, in which a waste feed chute is connected to a conveyor pipe, in the longitudinal direction of which a screw conveyor, drivable by a motor, is disposed, and in which the conveyor pipe discharges into a pyrolysis reactor, in particular into a low-temperature carbonization combustion drum that is rotatable about its longitudinal axis. The conveyor pipe is used for thermal waste disposal, especially according to the low-temperature carbonization combustion process.

The so-called low-temperature carbonization combustion process has become known in the field of waste disposal. The process and a system operating according to the process for thermal waste disposal are described, for instance, in Published European Patent Application 0 302 310 A1, as well as in German Published, Non-Prosecuted Patent Application DE 38 30 153 A1 corresponding partly to Published European Patent Application 0 360 052 A1. The system for thermal waste disposal according to the low-temperature carbonization combustion process includes a pyrolysis reactor and a high-temperature combustion chamber as its essential components. The pyrolysis reactor converts the waste being fed through a waste conveyor of the type referred to at the outset, into low-temperature carbonization gas and pyrolysis residue. The low-temperature carbonization gas and the pyrolysis residue are then delivered, after suitable preparation, to the burner of the high-temperature combustion chamber. That produces molten slag, which can be removed through an outlet and which is in vitrified form after it cools down. The flue gas being produced is sent through a flue gas line to a chimney serving as an outlet. A waste heat steam generator acting as a cooling device, a dust filter system, and a flue gas cleaning system, in particular, are built into the flue gas line. There is also a gas compressor in the flue gas line, which is disposed directly at the outlet of a flue gas scrubber system and can be constructed as a suction draft blower. The built-in gas compressor serves to carry gas through the system and in particular serves to maintain a negative pressure, however slight, in the pyrolysis drum. As a result of that negative pressure, low-temperature carbonization gas is prevented from passing out to the environment through ring seals of the pyrolysis drum.

Through the use of the conveying device, waste of various kinds, such as comminuted household garbage, industrial waste similar to household garbage, and comminuted bulk trash, as well as dewatered sludge, is fed to the low-temperature carbonization drum.

It has been found that in a low-temperature carbonization combustion system, the conveying device for waste can be blocked or destroyed if excessively large particles of waste drop from the waste feed chute into a coil of the conveying screw. However, the avoidance of blockage of the conveying screw is necessary for continuous operation. After all, as a rule, new trash or waste is supplied continuously. In order to provide problem-free conveying of the waste it is also necessary that the waste not stick to the screw or rotate with the screw coil. In order to achieve that, it is usual in conveying screws to place strips on a housing of its wall that protrude into an interstice between the conveying screw and the housing. When the conveying screw rotates, the material to be conveyed is prevented from rotating with the screw by the strips on the screw. However, such strips are subject to severe wear.

German Published, Non-Prosecuted Patent Applications DE 38 30 151 A1, DE 38 30 152 A1 and DE 38 30 153 A1, together corresponding to Published European Patent Application 0 360 052 A1, disclose pyrolysis reactors with a heater for waste, in which supply lines are provided with outlet nozzles for air on the end for the sake of direct heating of the waste in the low-temperature carbonization drum. Those supply lines are extended through a hot gas housing on the low-temperature carbonization drum. The known structures require special and therefore expensive sealing provisions.

SUMMARY OF THE INVENTION

It is accordingly an object of the invention to provide a device for conveying waste in a pyrolysis reactor, which overcomes the hereinafore-mentioned disadvantages of the heretofore-known devices of this general type and with which it is possible to lay at least one supply line that is intended to lead from the outside into the pyrolysis reactor, with comparatively little effort or expense.

With the foregoing and other objects in view there is provided, in accordance with the invention, a device for conveying waste, comprising a waste feed chute; a stationary conveyor pipe being connected to the waste feed chute and having a sealed-off end and a housing with a nonround cross section defining a longitudinal direction; a screw conveyor disposed in the longitudinal direction of the conveyor pipe; a motor for driving the screw conveyor; a pyrolysis reactor, in particular a low-temperature carbonization drum, into which the conveyor pipe discharges, defining a first space between the housing of the conveyor pipe and the pyrolysis reactor, the pyrolysis reactor having an inlet end and a longitudinal axis about which the pyrolysis reactor is rotatable; an inlet tube in which the sealed-off end of the conveyor pipe is disposed, defining a second space between the inlet tube and the conveyor pipe, the inlet tube communicating with the inlet end of the pyrolysis reactor and having a smaller cross section than the pyrolysis reactor; and at least one supply line leading from outside into the pyrolysis reactor, the at least one supply line being disposed in the first space and being extended through the second space.

Blockage of the conveying screw should be avoided as much as possible. In order to prevent the waste from rotating with the conveying screw, a deflection space may be provided between the conveying screw and the housing. This space is formed by ensuring that from the longitudinal axis of the conveying screw, measured outward at right angles to the longitudinal axis, a variably large spacing remains free between the largest radius of the conveying screw and the housing wall, depending on the radial direction in which measurement is taken. This assures that the conveyed waste can come loose from the conveying screw from time to time, so that it does not rotate with the conveying screw.

Advantageously, no strips need be attached to the inner wall surface of the housing as was previously usual for preventing the material from rotating with the conveying screw. While such strips are subject to major wear, the present conveying device can be operated largely with little wear. The housing has a circular cross section, for example.

In accordance with another feature of the invention, the housing has a polygonal cross section. This polygonal cross section may be a trough-shaped cross section, with a lower polygonal part and an upper rectangular part. It may also be a polygon with sides of equal length.

These embodiments also have the effect of preventing the waste to be conveyed from rotating with the conveying screw.

The supply line or lines can serve any possible purposes, such as supplying air to the pyrolysis reactor.

The conveying device can be used at the inlet and/or the outlet of the pyrolysis reactor.

In accordance with a further feature of the invention, the inlet tube has an end with a slide seal.

In accordance with an added feature of the invention, there is provided a chamber for the passage of heating gas being slidingly secured to the inlet tube.

In accordance with an additional feature of the invention, the supply line transports a medium selected from the group consisting of inert gas, water, water vapor and air.

In accordance with yet another feature of the invention, the at least one supply line has an outlet nozzle in the pyrolysis reactor.

In accordance with yet a further feature of the invention, the screw conveyor has segments of differing pitch.

With the objects of the invention view there is also provided, in accordance with the invention, in combination with a pyrolysis reactor being rotatable about its longitudinal axis and having an interior, a conveying device for feeding waste into and discharging waste out of the pyrolysis reactor, comprising an inlet tube being secured to the pyrolysis reactor, having a smaller cross section than the pyrolysis reactor, being rotatable with the pyrolysis reactor about its longitudinal axis, and having an end; a sealing ring secured to the end of the inlet tube; a stationary conveyor pipe protruding into the inlet tube and having an outer periphery and a housing with a nonround cross section defining a space between the housing and the inlet tube; a counterpart ring for the sealing ring, the counterpart ring being secured to the outer periphery of the conveyor pipe; and at least one extraction and supply line leading from outside through the space into the interior of the pyrolysis reactor.

Other features which are considered as characteristic for the invention are set forth in the appended claims.

Although the invention is illustrated and described herein as embodied in a device for conveying waste in a pyrolysis reactor, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
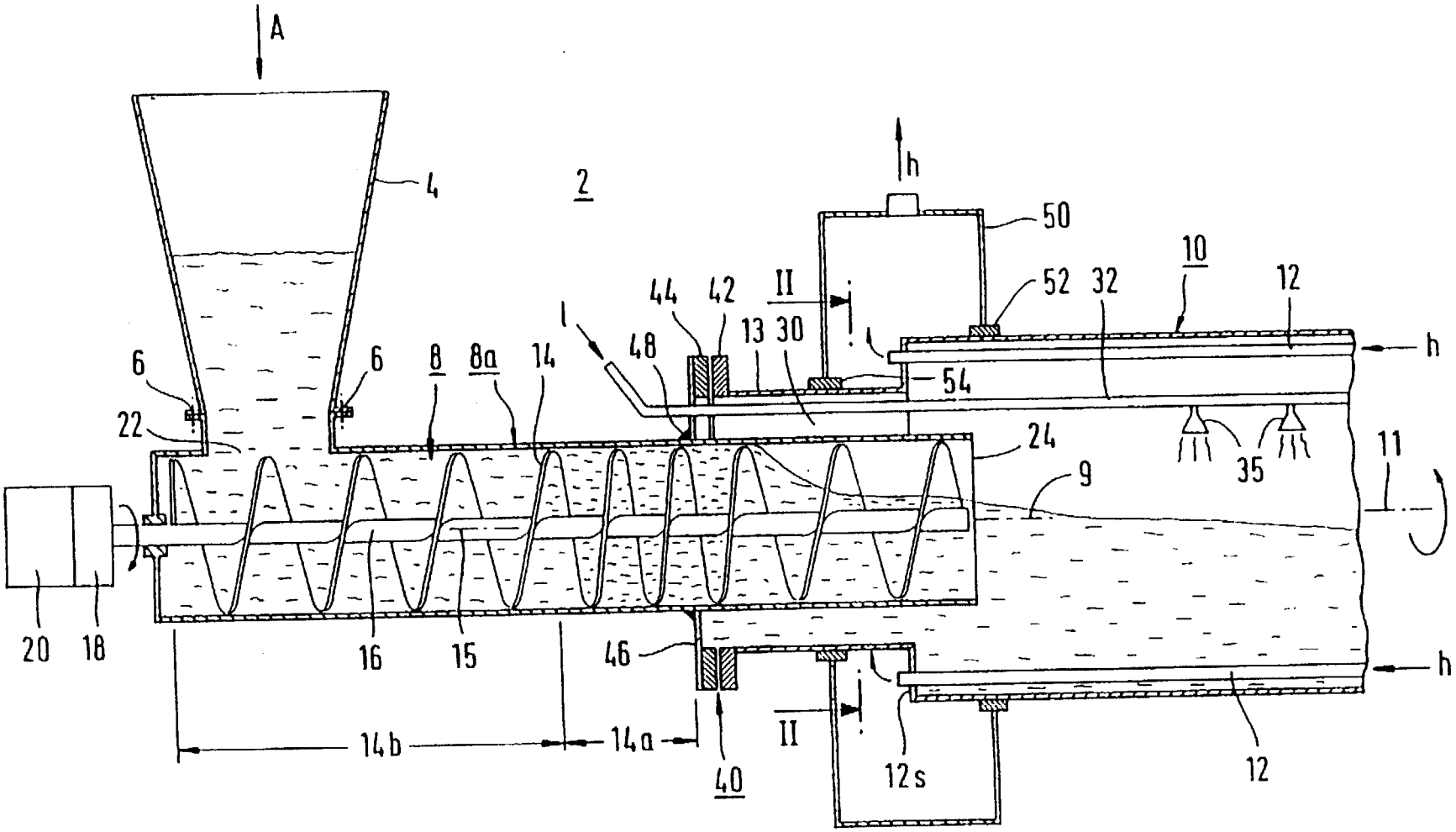
FIG. 1 is a fragmentary, diagrammatic, longitudinal-sectional view of a conveying device for waste, as part of a low-temperature carbonization combustion system.
Figure 2:
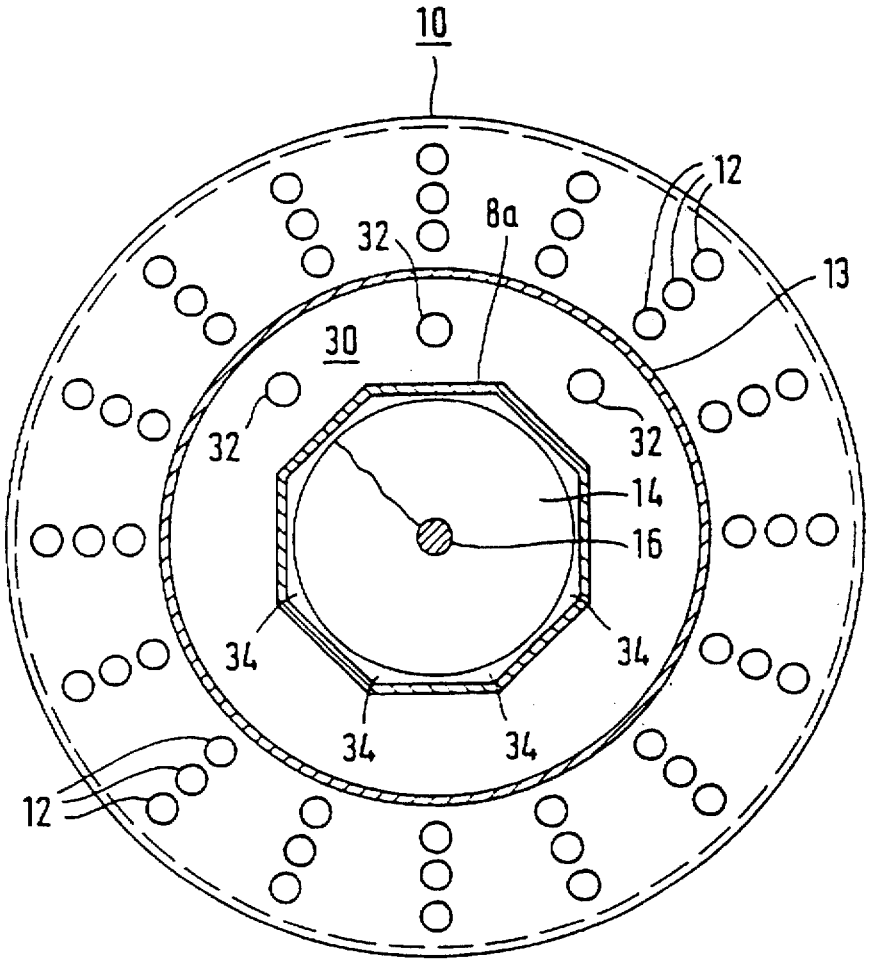
FIG. 2 is a cross-sectional view taken along a line II—II of FIG. 1, in the direction of the arrows.

Referring now to the figures of the drawings in detail and first, particularly, to FIG. 1 thereof, there is seen a conveying device 2 for waste A, in which a drop chute or waste feed chute 4 is connected through a disconnectable securing device 6 to a stationary conveyor pipe or channel 8. The conveyor pipe 8 in this case is constructed as a conveying screw trough. The conveyor pipe 8 has a housing 8*a* with a preferably polygonal cross section, as is shown in FIG. 2. A longitudinal axis of the housing 8*a* is shown at reference numeral 9. The conveyor pipe 8 discharges into a pyrolysis reactor 10, which in the present case is a low-temperature carbonization drum rotating about its longitudinal axis 11. The low-temperature carbonization drum 10 is equipped with a relatively large number of heating tubes 12 that are parallel to the longitudinal axis 11. The heating tubes 12, only two of which are shown in FIG. 1 and 48 of which are shown in FIG. 2, are charged with hot gas h, such as hot air. The heating tubes 12 are firmly fastened in an end ring 12*s*, which is concentrically adjoined by an inlet tube 13. An end of the conveyor pipe 8 is located concentrically within this inlet tube 13. As will be described below, provision is made at that point for good sealing.

The interior of the conveyor pipe 8, which in normal operational is stationary, contains a conveying screw or worm 14, having a longitudinal axis 15 which extends in the longitudinal direction thereof. A shaft 16 of the conveying screw 14 is driven through a gear 18 by a motor 20. The waste feed chute 4 is disposed laterally of or vertically above the conveyor pipe 8, on its end. A fill opening for the waste is indicated by reference numeral 22, and a discharge opening is indicated by reference numeral 24.

When waste A is conveyed from the drop chute 4 to the low-temperature carbonization drum 10, it is necessary both to prevent oxygen from the air from reaching the low-temperature carbonization drum 10 from the inlet opening 22 through the discharge opening 24, as well as to prevent low-temperature carbonization gas from reaching the environment from the low-temperature carbonization drum 10 through the fill opening 22, in countercurrent with the conveyed waste A. In order to do so, a middle portion 14*a* of the conveying screw 14 has a lesser pitch than the remainder of the conveying screw 14 or an initial portion 14*b*. As a result, the conveyed waste A is more severely compacted in the region of this middle portion 14*a* than in the other regions, and as a result in the region of the portion 14*a* of the conveying screw 14 virtually the entire portion of the space in the housing 8*a* of the conveyor pipe 8 is filled with the waste A. The conveyed waste A itself seals the housing 8*a* in gas-tight fashion at that location. Air cannot flow from the fill opening 22 to the discharge opening 24, and low-temperature carbonization gas cannot flow in the opposite direction. The conveying screw 14 again has a greater pitch downstream, as seen in the conveying direction of the compacting zone, which is located in the region of the portion 14*a* of the conveying screw 14. As a result, the packing of the waste A, which packing extends over the entire cross section of the conveyor pipe 8, is loosened up again.

An important factor is that because of the geometrical configuration, at least one extraction and supply line 32 leading from the outside into the pyrolysis reactor 10 is disposed in a first space 30 between the housing 8*a* of the conveyor pipe 8 and the pyrolysis reactor 10. In the present case, as is shown in FIG. 2, there are three supply lines 32. In this case a second space within the first space 30 is located between the housing 8*a* and the inlet tube 13. The supply lines 32 are located in "free corners" outside the housing 8*a*. The supply lines 32 are intended, for example, for introducing air 1, inert gas, water, or water vapor, which may be superheated. The air 1 being introduced can be used for partial combustion of low-temperature carbonization gas in the pyrolysis reactor 10. Two air outlet nozzles or combustion nozzles on the supply line 32 are shown at reference numeral 35 in FIG. 1. The waste in the pyrolysis reactor is heated and dried directly by introducing superheated steam.

Another significant factor is good sealing of the pyrolysis reactor 10 from the outside. To that end, a slide ring seal 40 is disposed on the end of the inlet tube 13. The slide ring seal 40 includes a co-rotating slide ring 42 and a stationary counterpart ring 44, both of which may be made of steel. The counterpart ring 44 is firmly attached to a ring 46, which is welded to the housing 8*a* with the aid of a weld seam 48.

In order to enable closing off the housing 8*a* of the conveyor pipe 8 in gas-tight fashion through the use of the conveyed waste A, the conveying device 2 should be operated fully filled. In order to prevent relatively large, hard pieces of waste A from blocking the conveying screw 14, variously located and configured deflection spaces 34 for such relatively large pieces may be provided inside the housing 8*a*, because of the geometrical shaping. In other words: the conveyor pipe 8 can have not merely the polygonal cross section shown but other cross sections instead. When the conveying screw 14 is rotating, the relatively large pieces to be conveyed are forced into these deflection spaces 34 and are transported along with the longitudinally moved waste A in the deflection spaces 34, so that they cannot block the conveying screw 14. The deflection spaces 34 as a rule are located above or to the side of the conveying screw 14.

In FIG. 1, the waste A in the rotating low-temperature carbonization drum is heated indirectly by the hot gas h through the use of the heating tubes 12. This hot gas h is fed into the low-temperature carbonization drum 10 through a non-illustrated stationary hot-gas inlet housing. The parallel heating tubes 12 are secured at one end to a bottom wall of the drum. The other end is secured to the end ring or bottom wall 12*s*, which forms a portion of a wall of a "cold" hot-gas outlet housing 50. From this housing 50, the hot gas h enters an outlet. In order to seal off the hot-gas outlet housing 50 from the rotating drum or tube 10 and from the inlet tube 13, respective ring seals 52 and 54 are provided. Non-illustrated Ring seals are correspondingly provided to seal off the hot-gas inlet housing. A non-illustrated discharge tube is extended from the interior of the low-temperature carbonization drum 10, or more precisely from the "hot" tube bottom, into the interior of a stationary discharge device. The low-temperature carbonization material entering this discharge device through the discharge tube is split, in the discharge device, into low-temperature carbonization gas and residue. The latter can be split and sorted out into various combustible and inert fractions through the use of a suitable non-illustrated device, according to the low-temperature carbonization combustion process, before the combustible portion is taken for combustion in a non-illustrated high-temperature combustion chamber.

It should also be pointed out that instead of or in addition to at least one supply line 32, it is naturally possible for an extraction line to also be disposed in the space 30 between the housing 8*a* of the conveyor pipe or channel 8 and the pyrolysis reactor 10 (or its inlet tube 13). This extraction line can serve, for instance, as a suction extraction tube for removing water vapor from the interior of the pyrolysis reactor 10. It should also be noted that a supply and/or extraction line 32 may be disposed at the outlet of the pyrolysis reactor 10, instead of at the inlet, by using an outlet tube that corresponds to the inlet tube 13.

We claim:

1. A device for conveying waste, comprising:

a waste feed chute;

a stationary conveyor pipe being connected to said waste feed chute and having a sealed-off end and a housing with a nonround cross section defining a longitudinal direction;

a screw conveyor disposed in the longitudinal direction of said conveyor pipe;

a motor for driving said screw conveyor;

a pyrolysis reactor into which said conveyor pipe discharges, defining a first space between said housing of said conveyor pipe and said pyrolysis reactor, said pyrolysis reactor having an inlet end and a longitudinal axis about which said pyrolysis reactor is rotatable;

an inlet tube in which said sealed-off end of said conveyor pipe is disposed, defining a second space between said inlet tube and said conveyor pipe, said inlet tube communicating with said inlet end of said pyrolysis reactor and having a smaller cross section than said pyrolysis reactor; and at least one supply line leading from outside into said pyrolysis reactor, said at least one supply line being disposed in said first space and being extended through said second space.

2. The conveying device according to claim 1, wherein said pyrolysis reactor is a low-temperature carbonization drum.

3. The conveying device according to claim 1, wherein said housing of said conveyor pipe has a polygonal cross section.

4. The conveying device according to claim 1, wherein said inlet tube has an end with a slide seal.

5. The conveying device according to claim 1, including a chamber for the passage of heating gas being slidingly secured to said inlet tube.

6. The conveying device according to claim 1, wherein said supply line is connected to a supply of a medium selected from the group consisting of inert gas, water, water vapor and air.

7. The conveying device according to claim 1, wherein said at least one supply line has an outlet nozzle in said pyrolysis reactor.

8. The conveying device according to claim 1, wherein said screw conveyor has segments of differing pitch.

9. In combination with a pyrolysis reactor being rotatable about its longitudinal axis and having an interior, a conveying device for feeding waste into and discharging waste out of the pyrolysis reactor, comprising:

a) an inlet tube being secured to the pyrolysis reactor, having a smaller cross section than the pyrolysis reactor, being rotatable with the pyrolysis reactor about its longitudinal axis, and having an end;

b) a sealing ring secured to said end of said inlet tube;

c) a stationary conveyor pipe protruding into said inlet tube and having an outer periphery and a housing with a nonround cross section defining a space between said housing and said inlet tube;

d) a counterpart ring for said sealing ring, said counterpart ring being secured to said outer periphery of said conveyor pipe; and e) at least one extraction and supply line leading from outside through said space into the interior of the pyrolysis reactor.

* * * * *